US006883695B2

(12) United States Patent
Orihara

(10) Patent No.: US 6,883,695 B2
(45) Date of Patent: Apr. 26, 2005

(54) TOILET PAPER HOLDER

(75) Inventor: Seiichi Orihara, Tokyo (JP)

(73) Assignee: Orihara Seisakusho Co., Ltd., Tokyo (JP)

( * ) Notice: Subject to any disclaimer, the term of this patent is extended or adjusted under 35 U.S.C. 154(b) by 0 days.

(21) Appl. No.: 10/057,996

(22) Filed: Jan. 29, 2002

(65) Prior Publication Data

US 2002/0100786 A1 Aug. 1, 2002

(30) Foreign Application Priority Data

Feb. 1, 2001 (JP) ..... 2001-025511

(51) Int. Cl.[7] ..... B26F 3/02
(52) U.S. Cl. ..... 225/46; 225/55; 225/71
(58) Field of Search ..... 225/46, 55, 42, 225/84, 67–70, 71, 22, 39, 44, 47, 89, 41, 36; D6/523; 206/389–417; 242/570–588.1

(56) References Cited

U.S. PATENT DOCUMENTS

| | | | | | |
|---|---|---|---|---|---|
| 316,368 | A | * | 4/1885 | Johnson | 225/22 |
| 405,121 | A | * | 6/1889 | Ross | 225/71 |
| 491,833 | A | * | 2/1893 | Gillespie | 84/476 |
| 648,837 | A | * | 5/1900 | Blue | 225/71 |
| 1,952,374 | A | * | 3/1934 | Hill | 225/23 |
| 2,035,704 | A | * | 3/1936 | Johnson | 225/68 |
| 2,818,221 | A | * | 12/1957 | Thieman | 225/67 |
| 3,319,855 | A | * | 5/1967 | Tucker et al. | 225/67 |
| 3,494,518 | A | * | 2/1970 | Goss | 225/34 |
| 3,516,615 | A | * | 6/1970 | Wickenberg | 242/596.3 |
| 4,099,681 | A | * | 7/1978 | House | 242/598.3 |
| 4,191,317 | A | * | 3/1980 | Harkins | 225/77 |
| 4,781,316 | A | * | 11/1988 | Freeberg | 225/71 |
| 4,844,368 | A | * | 7/1989 | Hu | 225/43 |
| 6,390,410 | B1 | * | 5/2002 | LaCount et al. | 242/571.5 |

* cited by examiner

*Primary Examiner*—Boyer Ashley
*Assistant Examiner*—Isaac N Hamilton
(74) *Attorney, Agent, or Firm*—Manabu Kanesaka

(57) ABSTRACT

A toilet paper holder is formed by a roll paper retainer, and a holding plate for cutting roll paper. The roll paper retainer include a back plate, a pair of holding members projecting forwardly from the back plate and having supporting members for rotatably supporting roll paper therebetween, and guide portions formed at two lateral sides of the back plate. The holding plate includes a rear plate vertically slidably fitted in the guide portions, and an upper plate projecting forwardly from the rear plate to move vertically together with the rear plate. A distal end portion is positioned on a substantially vertical line between the rotatable supporting members.

8 Claims, 10 Drawing Sheets

TOILET PAPER HOLDER

BACKGROUND OF THE INVENTION

1. Field of the Invention

The present invention relates to a toilet paper holder, which is constructed so that a user can readily cut paper by his one hand regardless of the remaining amount of roll paper.

2. Description of the Related Art

A conventionally provided toilet paper holder includes a cover body, which is supported so as to be freely rotatable vertically with respect to a roll paper main body.

However, the above cover body has a predetermined play in a rotatably supporting structure in order to readily attach a roll paper to a holder. For this reason, the cover body is lack of a function of cutting paper off the roll paper while holding paper by only cover body and keeping pressure in some degree; as a result, a problem has arisen such that the user is hard to readily cut the paper by his one hand.

Besides, the following problems have been found; more specifically, when drawing the paper out of the paper holder, the cover body jumps up, and then, contacts with the roll paper; for this reason, a chattering noise is generated. Further, the pressure by the cover body is insufficient; for this reason, the roll paper runs idle.

Considering the above-mentioned problems, in order to improve the conventional toilet paper holder, the present applicant has proposed the following toilet paper holder (disclosed in Japanese Utility Model Application Publication (Kokoku) No. 4-6638). In the toilet paper holder, the cover body holds paper by its self-weight in a state that the angle of the cover is fixed, and thereby, the paper is always held by uniform pressure without rattling the cover. Therefore, it is possible to smoothly and silently draw the paper from the holder, and to cut the paper by one hand without holding the cover.

The above-mentioned proposal has solved various problems arising in the conventional toilet paper holder. However, in the proposed toilet paper holder, the cover body has a cover plate, which is formed in a manner of projecting forwardly from a back plate, and being curved downwardly; as a result, the following problems have arisen.

The distal end portion of the cover body, that is, a portion having a function of cutting paper is positioned in front with respect to the center of roll paper; for this reason, the cover body is in a state of always covering the entirety of the upper portion of the roll paper. Thus, when an amount of paper is reduced, a clearance is generated between the distal end portion and the contact point of paper; as a result, a problem has arisen such that it is difficult to readily cut the paper by one hand.

More specifically, when an amount of paper is gradually reduced and a distance is generated between the distal end portion of the cover body and the roll paper, a paper pull-up force acting when cutting the paper and a paper holding force generated as its reaction are applied to the paper itself. In this case, since it seems that the paper is generally weak in a tensile force, the paper pull-up force is hard to effectively act; for this reason, it is impossible to readily cut the paper.

In a narrow space such as toilet, the user is forced to cut the paper from a toilet paper holder installed in only one direction by using his both hands; therefore, this requires extremely unnatural posture to the user. In view of aging society advancing rapidly in Japan of today, the above circumstances should be recognized as never overlooking problem.

Further, environmental service is required for social independence of the handicapped people; for this reason, it is securely and quickly desired to free such a barrier. Therefore, it is apparently necessary to improve related fixtures in a public facility such as toilet.

SUMMARY OF THE INVENTION

The present invention has been made in view of the above problems. Accordingly, an object of the present invention is to provide a toilet paper holder, which can uniformly and sufficiently hold a paper portion by a self weight of holding plate for cutting a roll paper so that a user can readily cut off the paper by his one hand, and can achieve the above effect regardless of an amount of remaining paper.

In order to achieve the above object, according to a first aspect, the present invention provides a toilet paper holder comprising: a roll paper retainer; a holding plate for cutting roll paper; and a roll paper rotatable supporting member, the retainer including a back plate having a guide portion for sliding the holding plate at its both side edges, and a pair of holding plates or members extending vertically from the back plate, which is provided with the rotatable supporting member movable so that a roll paper is freely removable. The holding plate includes a back or rear plate, which is fitted into the guide portion of the retainer and is slidable, and an upper plate, which has a substantially vertical bent portion, and is formed so as to forwardly project, a distal end portion of the upper plate being positioned on a substantially vertical line from the center of the roll paper.

Further, according to a second aspect, the present invention provides a toilet paper holder comprising: a roll paper retainer; a holding plate for cutting roll paper; and a roll paper rotatable supporting member, the retainer including a back plate having a guide portion for sliding the holding plate at its both side edges, and a pair of holding plates or members extending vertically from the back plate, which is provided with the rotatable supporting member movable so that a roll paper is freely removable. The holding plate includes a back or rear plate, which is fitted into the guide portion of the retainer and is slidable, and an upper plate, which has a substantially vertical bent portion, and is formed so as to forwardly project, a distal end portion of the upper plate being positioned on a substantially vertical line from the center of the roll paper, and having a slight clearance so as not to contact with the roll paper rotatably supported.

DESCRIPTION OF THE PREFERRED EMBODIMENTS

Figure 1:
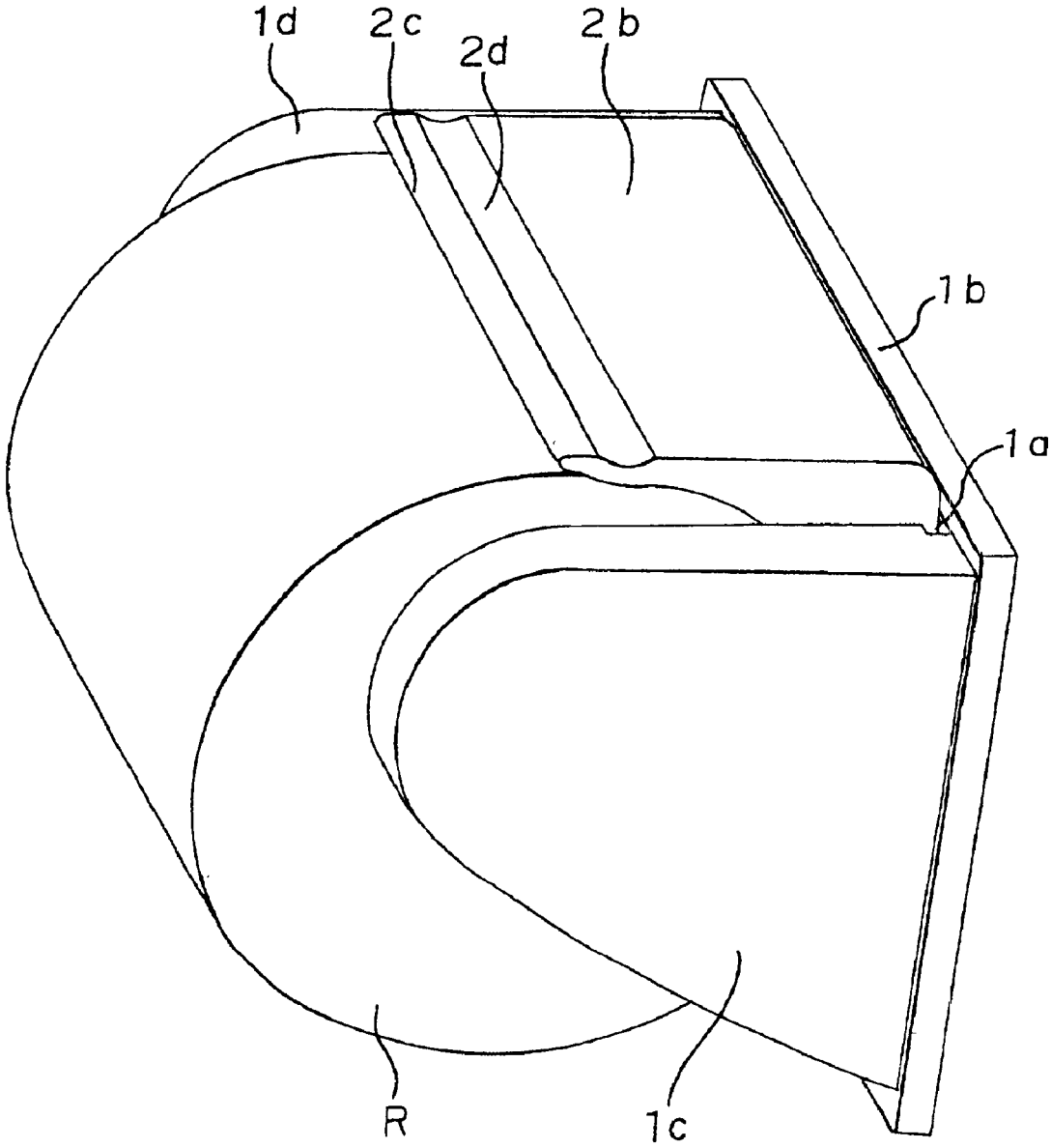
FIG. 1 is a perspective view showing a toilet paper holder according to one embodiment of the present invention.
Figure 2:
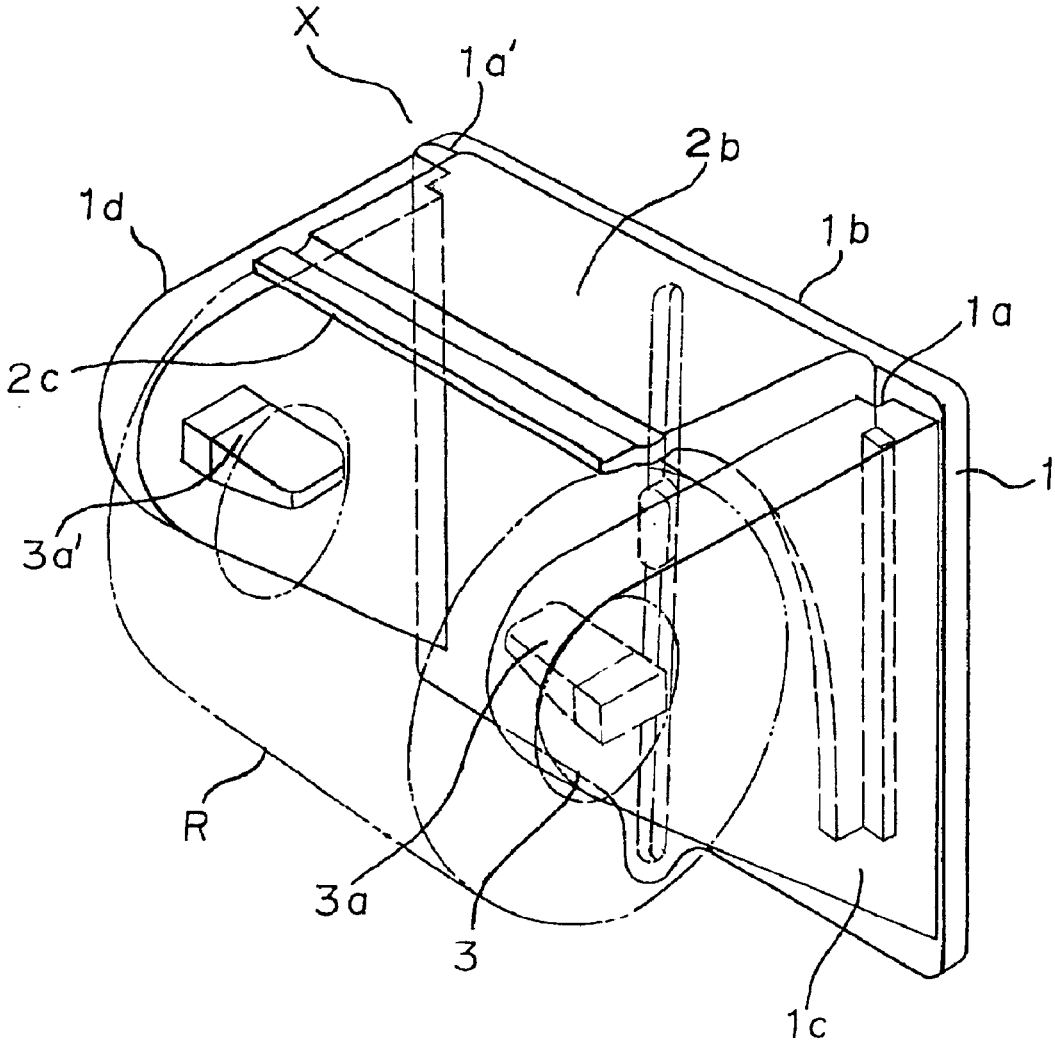
FIG. 2 is a perspective view showing the toilet paper holder according to one embodiment of the present invention.
Figure 3:
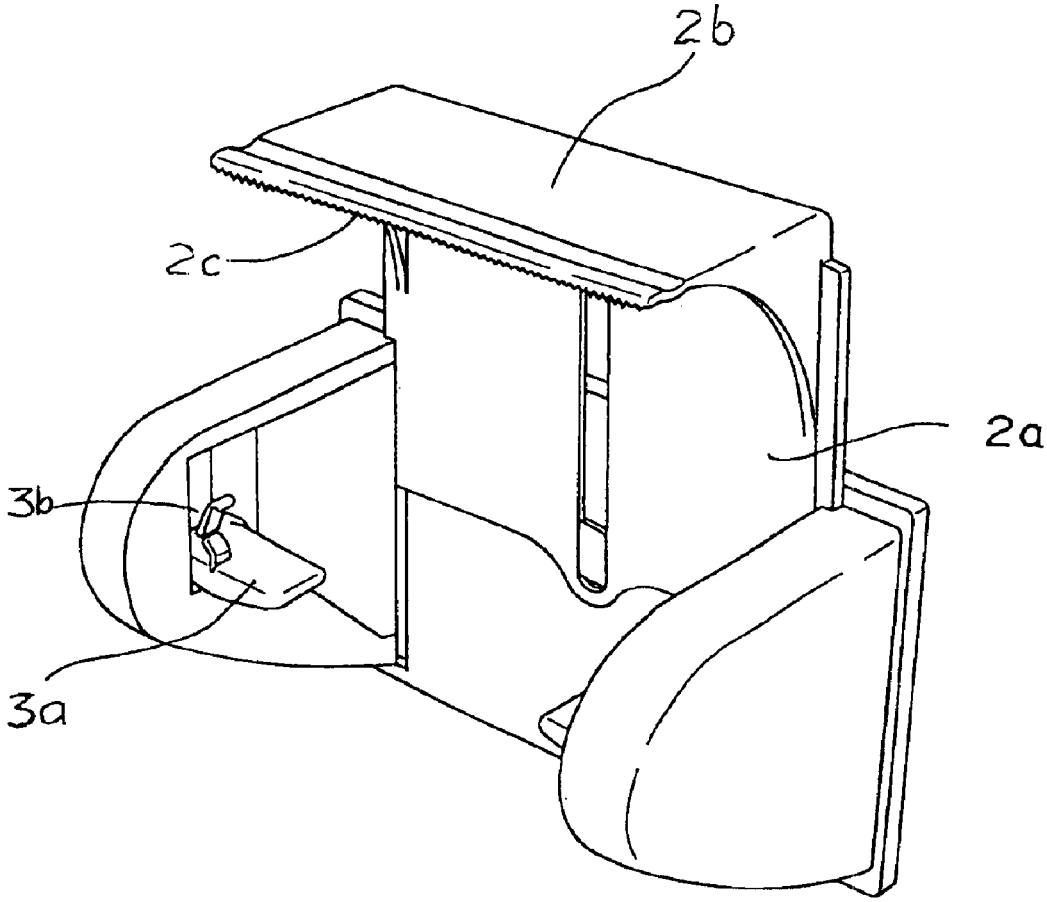
FIG. 3 is a perspective view showing the toilet paper holder according to one embodiment of the present invention.

The embodiment of the present invention will be described with reference to the drawings.

A toilet paper holder (X) of the invention has a basic structure comprising a roll paper retainer (1), a holding plate (2) for cutting a roll paper, and a roll paper rotatable supporting members (3*a*). For example, a synthetic resin is generally used as the material of the toilet paper holder because it has a lightweight and excellent in durability.

The roll paper retainer (1) has a basic structure comprising a substantially rectangular back plate (1*b*) including a guide portion (1*a*) and a pair of holding plates (1*c*, 1*d*) extending vertically from both edges of the back plate (1*b*), and these members are integrally molded.

The guide portion (1*a*) is portions (1*a*) are provided at the holding plates (1*c*, 1*d*) on both sides of the back plate (1*b*). A back plate (2*a*) of the holding plate (2) for cutting roll paper is fitted into the grooves.

The holding plates (1*c*, 1*d*) are individually respectively provided with a roll paper rotatable supporting members (3*a*) at their facing inner surfaces. The rotatable supporting member (3*a*) has a movable structure such that the roll paper is freely removable.

Further, the back plate (1*b*) of the roll paper retainer is formed with a projecting square member at the center portion. The member is fitted into an upper portion of a groove formed at the center portion of the back plate of the holding plate (2) for cutting roll paper. By doing so, it is possible to prevent the holding plate (2) from falling down even in the case where a roll paper (R) is not attached to the holder.

The holding plate (2) for cutting roll paper has a basic structure comprising a back plate (2*a*), which is fitted into the guide portions (1*a*) of the retainer (1) and is slidable, and a holding portion (2*b*), which is formed in a manner of having a substantially vertical bent portion and forwardly projecting from the back plate (2*a*). These members are integrally molded.

The holding portion (2*b*) is formed into a shape of plane, and has no shape of being downwardly curved along the shape of roll paper as the conventionally provided toilet paper holder.

The distal side portion (2*c*) of the holding portion (2*b*) is positioned on the substantially vertical line from the center of the roll paper (R).

The construction is employed, and thereby, the distal side portion of the holding portion, that is, a paper cut portion contacts with the roll paper; therefore, a paper pull-up force acting when cutting the paper and a paper holding force generated as its reaction act as a force of rotating the roll paper. The force disperses around the roll paper; as a result, it is possible to effectively apply a force of pulling up the paper, and thus, to readily cut the paper.

In this case, the distal side portion (2*c*) is formed like a tip of blade in order to readily cut the paper.

Moreover, in a toilet paper holder according to the second aspect, the holding portion (2*b*) has a structure having a slight clearance so that the distal end portion (2*c*) does not directly contact with the roll paper rotatably supported.

The construction is employed, and thereby, the distal end portion of the holding plate does not directly contact with the surface of the roll paper; therefore, it is possible to prevent a paper dust generated when drawing the roll paper out of the holder.

Figure 4:
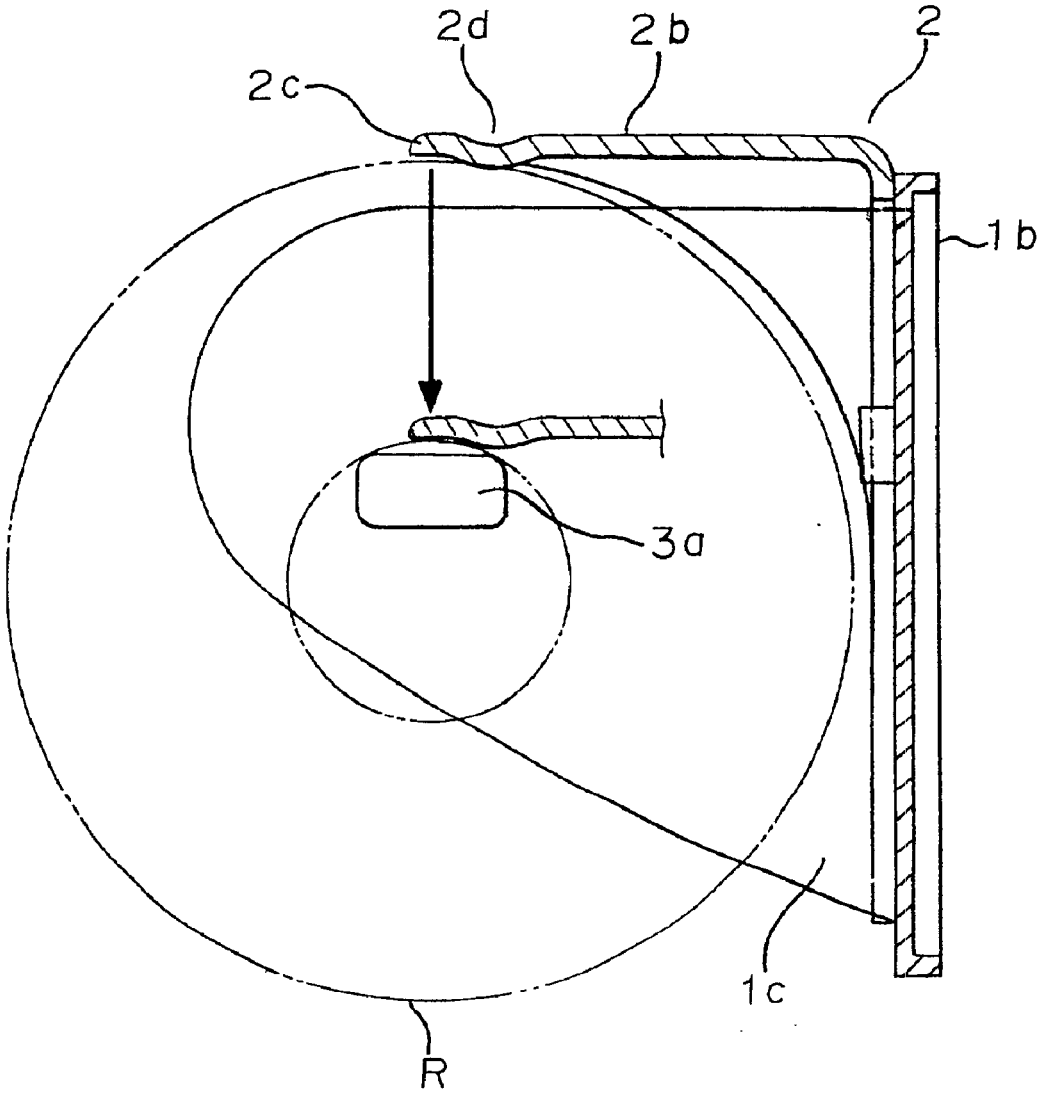
FIG. 4 is a side view in partly section showing the toilet paper holder according to one embodiment of the present invention.
Figure 5:
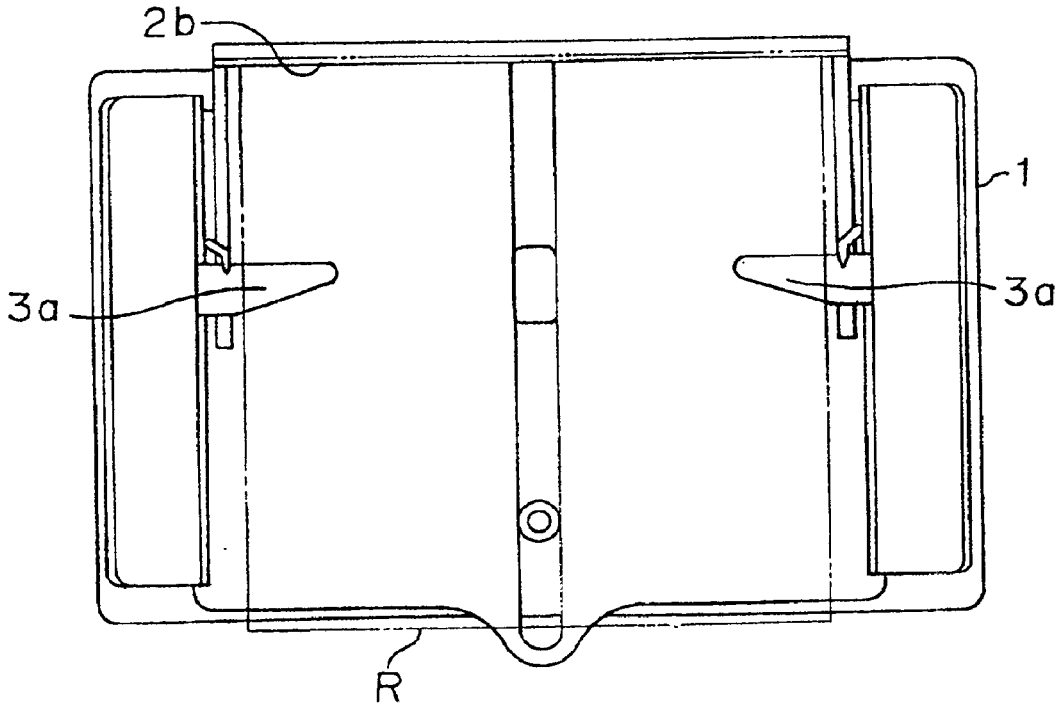
FIG. 5 is a plan view showing the toilet paper holder according to one embodiment of the present invention.
Figure 6:
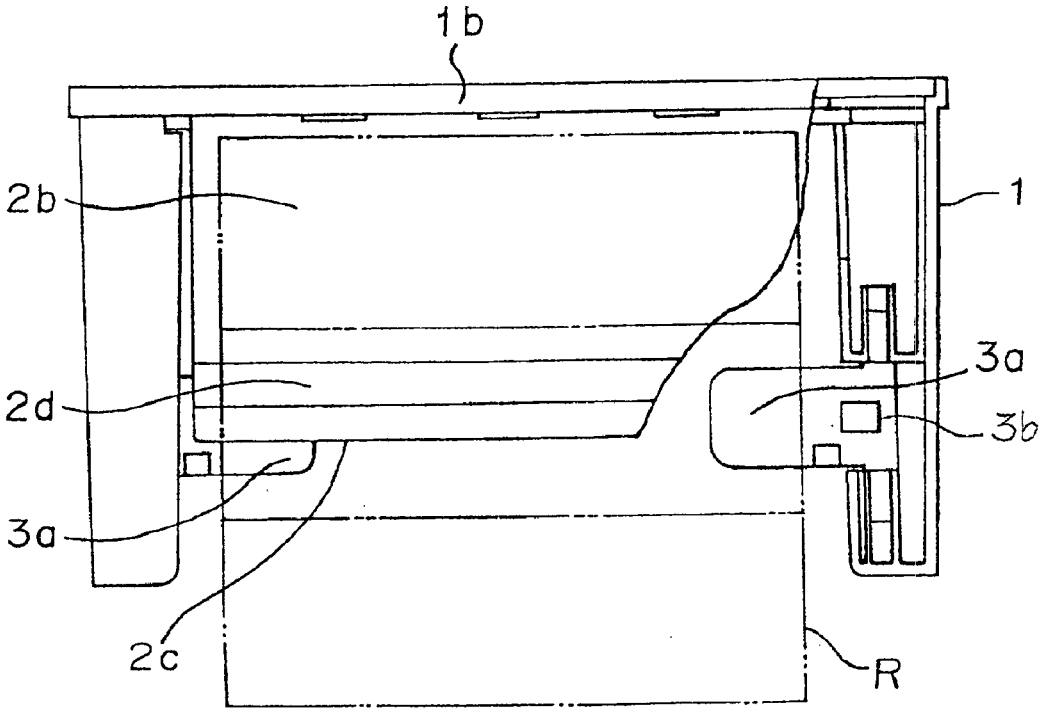
FIG. 6 is a front view showing the toilet paper holder according to one embodiment of the present invention.
Figure 7:
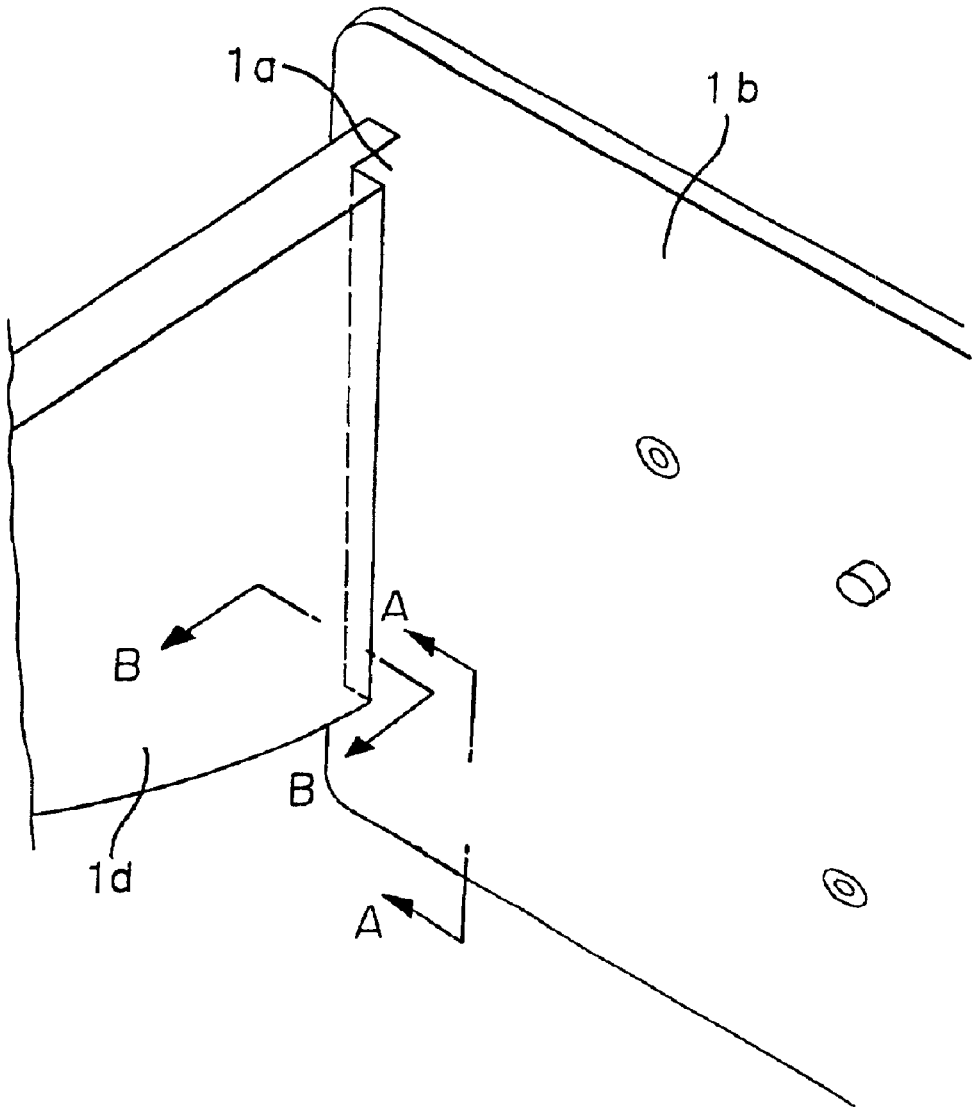
FIG. 7 is a perspective view showing one corner of a roll paper retainer of the toilet paper holder according to one embodiment of the present invention.
Figure 8:
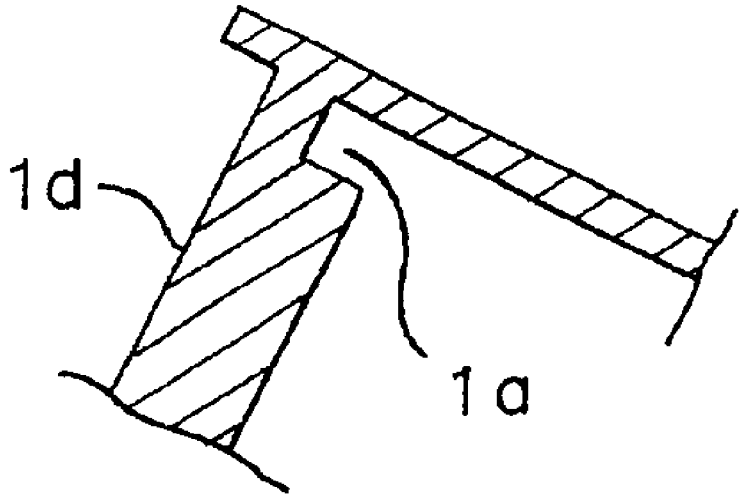
FIG. 8 is a sectional view showing a guide portion of the roll paper retainer of the toilet paper holder according to one embodiment of the present invention.
Figure 9:
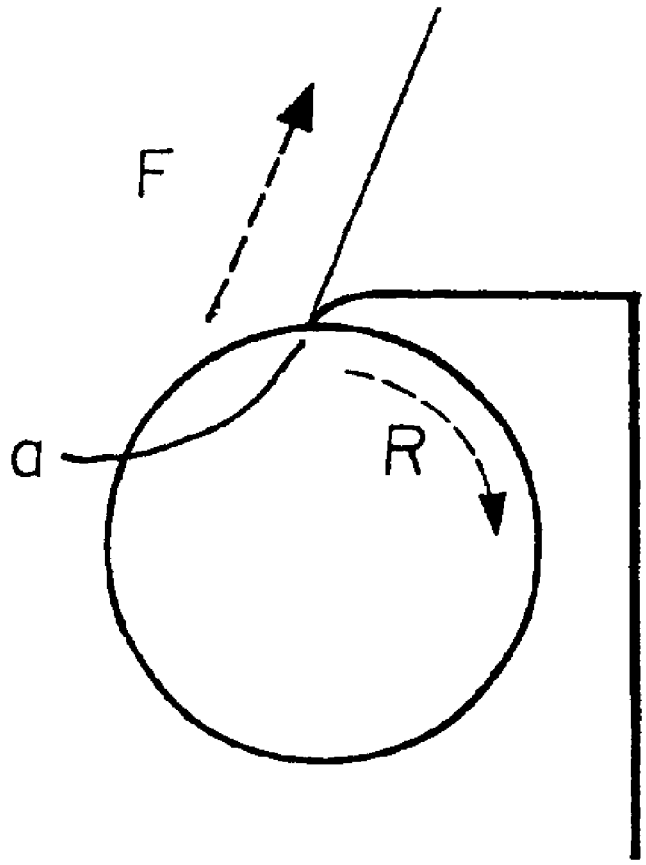
FIG. 9 is a conceptual view to explain a force acting when cutting paper in the toilet paper holder according to the present invention.
Figure 10:
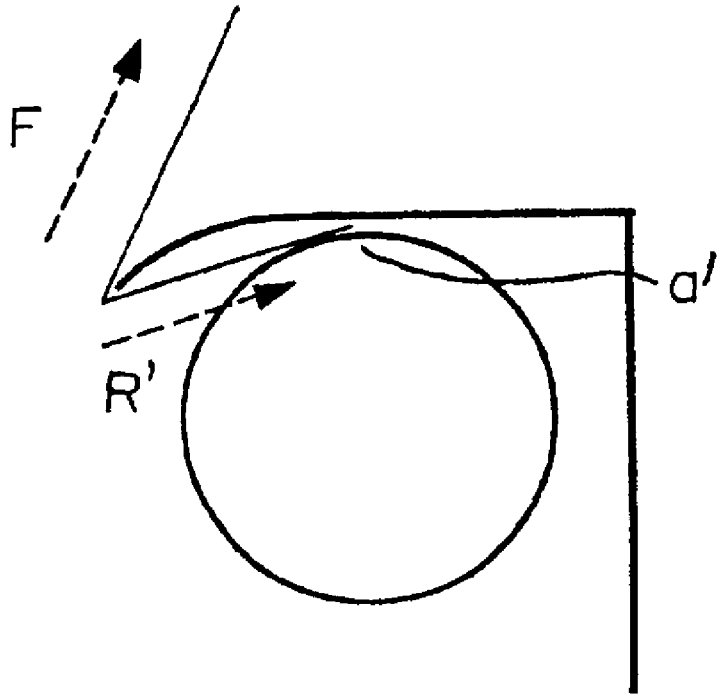
FIG. 10 is a conceptual view to explain force acting when cutting paper in a conventional toilet paper holder.

As shown in FIG. 4, a directly contact portion (2*d*) of the distal end portion holds the surface of the roll paper; therefore, it is possible to fully achieve the principal object of the present invention, that is, to readily cut the paper by one hand.

The holding plates (1*c*, 1*d*) are provided with roll paper rotatable supporting members (3*a*) at the facing inner faces. For example, according to a third aspect, the toilet paper holder may be provided with a pawl portion (3*b*), which extends to the roll paper side in a state of being inclined. By doing so, it is possible to prevent the roll paper from shifting right and left.

Accordingly, the toilet paper holder is constructed in the manner as described above; therefore, the present invention has the following effect.

More specifically, the present invention provides a toilet paper holder, which can uniformly and sufficiently hold a paper portion by a self weight of holding plate for cutting a roll paper so that a user can readily cut off the paper by his one hand, and can achieve the effect regardless of an amount of remaining paper.

What is claimed is:

1. A toilet paper holder comprising:

a roll paper retainer including a back plate, a pair of holding members projecting forwardly from the back plate and having supporting members for rotatably supporting roll paper therebetween, and guide portions formed at lateral sides of the holding members adjacent to the back plate, and a holding plate for cutting roll paper, said holding plate including a rear plate extending parallel to the back plate and vertically slidably fitted in the guide portions, and an upper plate projecting forwardly from the rear plate to move vertically together with the rear plate and having a distal end portion positioned substantially on a line between the supporting members.

2. A toilet paper holder according to claim 1, wherein said upper plate is immovably fixed to the rear plate and projects substantially horizontally relative to the rear plate.

3. A toilet paper holder according to claim 1, wherein said supporting members include pawl portions extending obliquely and facing each other.

4. A toilet paper holder according to claim 2, wherein said guide portions are formed on inner surfaces of the holding members adjacent to the back plate so that the holding plate moves vertically according to a size of the roll paper.

5. A toilet paper holder according to claim 1, wherein said guide portions are grooves formed in the holding members.

6. A toilet paper holder according to claim 5, wherein said rear plate has a length to move only along the guide portions without tilting relative to the back plate.

7. A toilet paper holder according to claim 6, wherein said upper plate further includes a directly contact portion formed adjacent to the distal end portion and projecting downwardly from the upper plate so that the distal end portion does not directly contact the roll paper.

8. A toilet paper holder according to claim 1, wherein said rear plate and said upper plate form an L-shape.

* * * * *